US007895673B2

(12) United States Patent
Forselius et al.

(10) Patent No.: US 7,895,673 B2
(45) Date of Patent: Mar. 1, 2011

(54) WAISTBAND EXTENDER

(76) Inventors: Kristin Forselius, Lee, NH (US); Anna M. Forselius, Guilford, CT (US)

( * ) Notice: Subject to any disclaimer, the term of this patent is extended or adjusted under 35 U.S.C. 154(b) by 445 days.

(21) Appl. No.: 11/202,681

(22) Filed: Aug. 13, 2005

(65) Prior Publication Data

US 2007/0033709 A1 Feb. 15, 2007

(51) Int. Cl.
*A04D 1/06* (2006.01)

(52) U.S. Cl. ..... 2/237

(58) Field of Classification Search ..... 2/237, 2/221, 215, 234, 236, 219, 220, 227, 76, 2/79, 338, 311–312, 336
See application file for complete search history.

(56) References Cited

U.S. PATENT DOCUMENTS 4,580,298 A * 4/1986 Tuisl ..... 2/237
5,575,011 A * 11/1996 Allen ..... 2/227
6,085,356 A * 7/2000 Redmond, Sr. ..... 2/237
6,219,848 B1 * 4/2001 Russell ..... 2/221
6,253,424 B1 * 7/2001 Rainville-Lonn ..... 24/306
6,286,152 B1 * 9/2001 Mooneyhan et al. ..... 2/266
6,536,639 B1 * 3/2003 Frank ..... 224/257
6,887,223 B2 * 5/2005 Bisbee ..... 604/353

* cited by examiner

*Primary Examiner*—Tejash Patel
(74) *Attorney, Agent, or Firm*—James Wiegand

(57) ABSTRACT

A waistband extender comprises a plurality of joined loops, at least a portion of at least one of the loops being substantially composed of a material having elastic properties. At least one loop, an engaging loop, is configured to engage a waistband button. A remaining portion of the waistband extender is configured to thread through the buttonhole with which the button mates. A second loop within the remaining portion of the waistband extender engages the button, thereby securing the waistband's button/buttonhole combination, while providing a greater separation than the button/buttonhole combination alone normally would provide.

20 Claims, 4 Drawing Sheets

WAISTBAND EXTENDER

CROSS-REFERENCE TO RELATED APPLICATIONS

None

FIELD OF THE INVENTION

The invention relates to garments and, more particularly, to an apparatus that allows for the extension of a garment's waistband.

BACKGROUND OF THE INVENTION

Pregnancy may be miraculous, but it can be extremely uncomfortable. Anything, no matter how minor it may seem, that reduces the discomfort of pregnancy would be a godsend to millions of women the world over. One element of discomfort associated with pregnancy is the distension of the mother's belly. Not only is the enlargement of the belly uncomfortable, in and of itself, the discomfort can be exacerbated by the constriction of an unforgiving waistband. In order to avoid such discomfort, one could buy new clothes for each waist-size extension (and suffer discomfort between standard waist-sizes), accumulating a storehouse of outfits that, if fashions don't change and the clothes are not donated to a charity organization in the meantime, might, possibly, be used during a subsequent pregnancy. Because few people have the wealth of Croesus (or Midas, for that matter), it is generally impractical to buy sets of clothes to accommodate each size transition that a mother will pass through during the course of her pregnancy. There is often a reluctance to make the transition from one size to a larger size, particularly during the early stages of a pregnancy.

Pregnancy isn't the only condition during which waists may expand. Many people experience some fluctuation in their weight over time. People often become more sedentary during the winter months, when they're less likely to be outside engaging in calorie-burning activities. The fall and winter also bring holidays, with their traditional big meals and calorie-laden treats. "Packing on a few pounds" during the holidays can transform otherwise comfortable garments into tight-waisted, binding, uncomfortable, constrictors. Additionally, people become bloated for a variety of reasons, rendering their waistbands constrictive and uncomfortable. Futhermore, because not everyone can afford custom-tailored clothes, garments, such as pants or skirts, that feature waistbands, may fit a person in the waist, but not in the hips, or vice versa.

An apparatus for providing relief from constricting waistbands is highly desirable. The need for such an apparatus during the first months of pregnancy, when a mother is just beginning to "show" is particularly acute.

SUMMARY

A waistband extender in accordance with the principles of the present invention comprises a plurality of loops, at least a portion of at least one of the loops being substantially composed of a material having elastic properties, such as natural or synthetic rubber, for example. The waistband extender in accordance with the principles of the present invention is compact, so that it may be easily carried, in a pocket or a purse, for example. Additionally, the waistband extender is easy to use. At least one loop, an engaging loop, is configured to engage a waistband button. A remaining portion of the waistband extender in accordance with the principles of the present invention is configured to thread through the buttonhole with which the button mates. A second loop within the remaining portion of the waistband extender engages the button, thereby securing the waistband's button/buttonhole combination, while providing a greater separation than the button/buttonhole combination alone normally would.

In an illustrative embodiment, the engaging loop (that is, the loop that is designed to be placed over the button first) is of a diameter not much greater than the outside diameter of the button that it is engaging. The engaging loop thereby provides a snug mating engagement with the button in a manner much like the buttonhole with which the button normally engages would do. In an illustrative two-loop embodiment, the loop that is not the engaging loop, (sometimes referred to herein as the "threading loop" because, in operation, it is threaded through the buttonhole) is longer than the engaging loop, permitting it to be threaded through the buttonhole and return to the button with enough material to still engage with the button. However, the engaging and threading loops may be of the same diameter. Not only may elastic materials be employed in the composition of the waistband extender in order to accommodate a plurality of size extensions, a plurality of threading loops, differing distances from the engaging loop, may be employed to provide different extension lengths for the waistband extender.

A multi-loop waistband extender in accordance with the principles of the present invention may be formed, for example, by sewing, or otherwise joining (that is, stapling, weaving, crimping, clamping, grommet button combination, hook and loop, or riveting, for example), individual loops together. Each loop may be of single-band or multi-cord construction, may be braided or woven and may exhibit a rectangular or elliptical (which may be circular) cross section. In an illustrative embodiment, the elastic material of the loops is cloth-covered. One or more sections of one or more of the loops may include an area for decoration that may include logos, for example.

BRIEF DESCRIPTION OF THE DRAWINGS

The above and further features, aspects, and advantages of the invention will be apparent to those skilled in the art from the following detailed description, taken together with the accompanying drawings in which.

DETAILED DESCRIPTION

Figure 1:
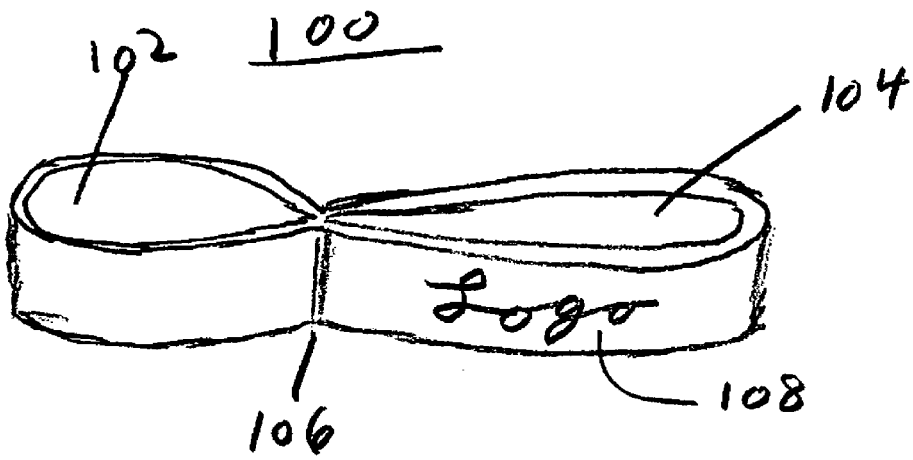
FIG. 1 is a perspective view of a multi-loop waistband extender.

In the landscape view of FIG. 1 a multi-loop waistband extender 100 in accordance with the principles of the present invention includes two loops, at least a portion of one of the loops being substantially composed of a material having elastic properties. In this illustrative embodiment, both loops are composed of material that exhibits elastic properties. Many such materials are known and are widely available. For example, materials variously referred to as knitted, webbed, or braided elastics are available from a number of manufacturers and are available in various lengths and widths. Other materials, such as clear elastics, could also be employed to form all or part of the one or more loops substantially composed of elastic material in a waistband extender in accordance with the principles of the present invention. The elastic materials may include natural or synthetic rubber, for example.

In the illustrative embodiment of FIG. 1 an engaging loop 102, is configured to engage a waistband button. The loop 102 is the engaging loop of this illustrative embodiment (that is, the loop that is designed to be placed over the button first). The non-stretched diameter of the loop 102 is sized to provide a snug, secure fit with the waistband button with which it is designed to engage. Thus, the non-stretched diameter of the loop 102 may range from less than that of the outside diameter of the waistband button with which it is designed to engage to a diameter that is slightly greater than the outside diameter of the button. The engaging loop thereby provides a snug mating engagement with the button in a manner much like the buttonhole with which the button normally engages would do. A second loop 104 within the remaining portion of the waistband extender, which, in this illustrative embodiment, composes the remaining portion of the waistband extender, is configured to thread through the buttonhole with which the button mates and engage the button, thereby securing the waistband's button/buttonhole combination, while providing a greater separation than the button/buttonhole combination alone normally would. In this illustrative embodiment, the threading loop 104 is longer than the engaging loop 102, permitting it to be threaded through the buttonhole and return to the button with enough material to still engage with the button.

A joint 106 forms the boundary between the engaging loop 102 and threading loop 104. The joint may be formed through a variety of mechanisms, such as, stapling, weaving, crimping, clamping, grommetibutton combination, hook and loop, or riveting, for example. Each loop may be of single-band or multi-cord construction, may be braided, knitted or woven and may exhibit a rectangular or elliptical (which may be circular) cross section. In the illustrative embodiment of FIG. 1, the waistband extender 100 includes an area 108 for decoration. The decoration may include such things as a logo, for example, and it is contemplated within the scope of the invention that the entire waistband extender 100, or any portion of it, may be covered by decorative or other designs that may be implemented using beads, buttons, or threading, for example. Decorative items may be permanently or detachably fixed to the decorative area 108. In an illustrative embodiment, the decorative are could include any portion of the waistband extender. That is, any or all of the waistband extender may include decoration.

Figure 2:
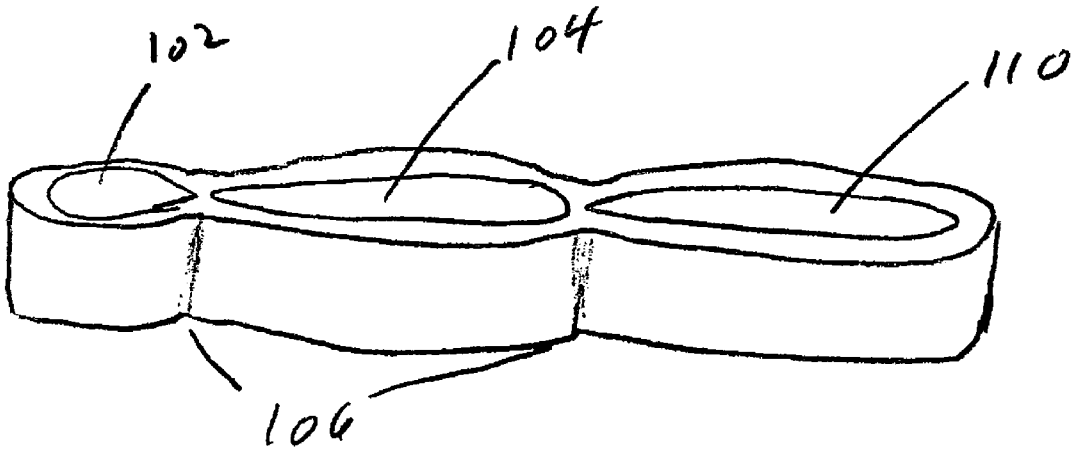
FIG. 2 is a perspective view of a three-loop multi-loop waistband extender.

In FIG. 2 a multi-loop waistband extender in accordance with the principles of the present invention includes an engaging loop 102 a threading loop 104 and a second threading loop 110. The engaging loop 102 and threading loop 104 are as previously described. The second threading loop 110 provides a user more waistband extension options. That is, for the earliest stages of a pregnancy, for example, the first threading loop 104 may be engaged with a waistband button to provide a certain degree of waistband extension. Later in the pregnancy, when the mother's belly becomes more distended, the second threading loop 110 may be engaged with the waistband button, thereby providing a greater degree of waistband extension to the prospective mother. Additional threading loops, that provide more extension options, are contemplated within the scope of the invention.

Figure 3:
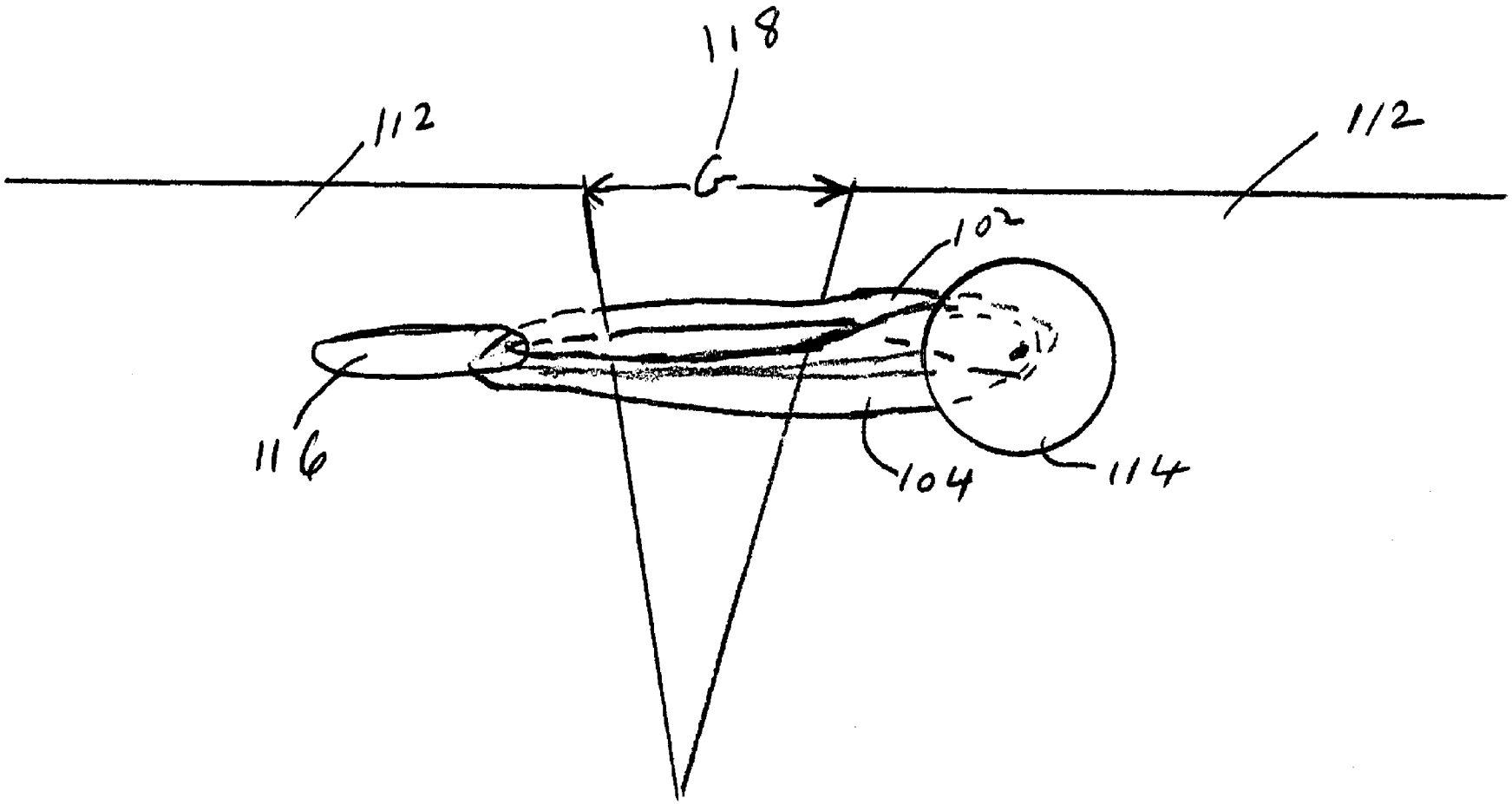
FIG. 3 is a plan view of a two-loop waistband extender in use.

The front plan view of FIG. 3 illustrates the use of a waistband extender 100 in accordance with the principles of the present invention. A garment includes a waistband 112, a button 114, and a buttonhole 116. Normally, the gap 118 between the two garment pieces (that is, the one piece to which the button is attached and the other piece within which the buttonhole is formed) is closed by engagement of the button 114 with the buttonhole 116. In this illustrative embodiment a waistband extender 100 in accordance with the principles of the present invention engages the button 114 with an engagement loop 102. The waistband extender's threading loop 104 is threaded through the buttonhole 116 and is engaged with the button 114. Because at least a portion of at least one of the waistband extender 100 loops is composed of material that exhibits elastic properties, the gap 118 will vary in extent, depending upon the pressure applied to it, to accommodate the waist encompassed by the waistband 112.

Figure 4:
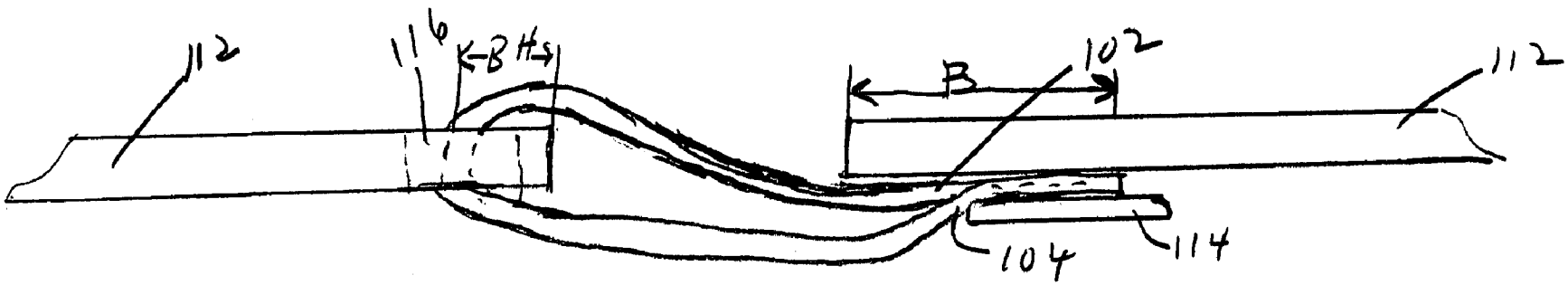
FIG. 4 is a top plan view of a two-loop waistband extender in use.

The top plan view of FIG. 4 illustrates the use of a waistband extender 100 in accordance with the principles of the present invention from a different angle. The waistband 112, button 114, buttonhole 116, and the gap 118 between the two garment pieces are as previously described. The waistband extender 100 engages the button 114 with an engagement loop 102 and its threading loop 104 is threaded through the buttonhole 116 and is engaged with the button 114. The distance of the gap, G, 118 ranges between a lower and upper limit, approximately as follows:

$$\tfrac{1}{2}UL - 2B - 2BH \text{ to } \tfrac{1}{2}FEL - 2B - 2BH$$

Where:

UL=the un-stretched length of the waistband extender

FEL=the fully extended length of the waistband extender

Figure 5A:
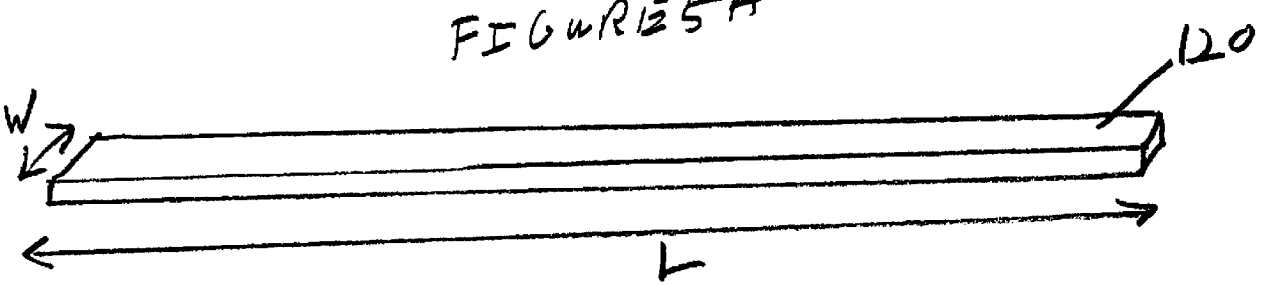
FIGS. 5A through 5C are plan views illustrating the construction of multi-loop waistband extenders in accordance with the principles of the present invention.
Figure 5B:
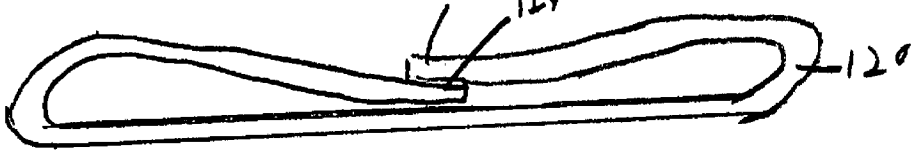
Figure 5C:
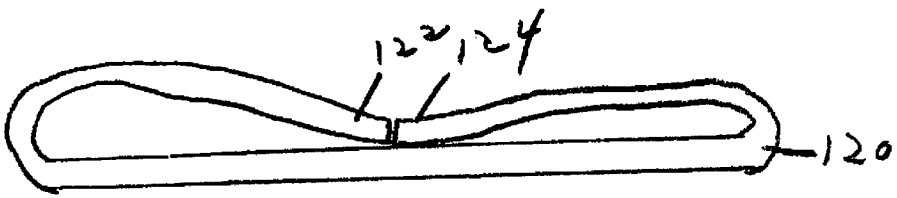

B=the distance from the engaging loop's point of contact with the button opposite the gap to the button's side edge of the garment adjacent the gap BH=the distance from the threading loop's point of contact with the buttonhole to the buttonhole's side edge of the garment adjacent the gap The top plan views of FIGS. 5A, 5B and 5C illustrate the construction of a two-loop embodiment of a waistband extender in accordance with the principles of the present invention. FIG. 5A illustrates a single length of polyester braided elastic band 120. The length, L, of the band 120 is chosen to yield a double-loop waistband extender that provides a relief gap 118 of a predetermined range when the finished waistband extender is employed. The width, W, of the band 120 is chosen to ease insertion and threading of the waistband extender through a buttonhole 116. That is, the width should be great enough to provide sufficient strength and resistance to prevent the extender's "bottoming out" (that is, becoming fully stretched) too easily, but not so wide as to make the threading of the extender through a buttonhole difficult. Additionally, the width, W, (and related resistance) should also be selected so that the extender allows for some "play" (that is, some variability of length). That is, the width, W, and elastic material of the band 120 are chosen so that the resistance is not so light that the extender bottoms out and not so great that the extender provides no variability of length.

FIG. 5B illustrates a lap-jointed embodiment of a two-loop waistband extender in accordance with the principles of the present invention. In this illustrative embodiment, the two ends 122 and 124 of the band 120 are overlapped, fixed to one another and fixed to an interior section of the band 120 to thereby form a two-loop waistband extender. As previously described the joint may be created by any of a variety of fixing means, including, for example: sewing, stapling, weaving, crimping, clamping, grommetibutton combination, hook and loop, or riveting. FIG. 5C illustrates a butt-jointed embodiment of a two-loop waistband extender in accordance with the principles of the present invention. In this illustrative embodiment, the two ends 122 and 124 of the band 120 are butted to one another and fixed, through means such as sewing, etc., to an interior section of the band 120 to thereby form a two-loop waistband extender.

The foregoing description of specific embodiments of the invention has been presented for the purposes of illustration and description. It is not intended to be exhaustive or to limit the invention to the precise forms disclosed, and many modifications and variations are possible in light of the above teachings. The embodiments were chosen and described to best explain the principles of the invention and its practical application, and to thereby enable others skilled in the art to best utilize the invention. It is intended that the scope of the invention be limited only by the claims appended hereto.

What is claimed is:

1. A waistband extender for use with a garment waistband that employs a waistband button and mating waistband buttonhole for mutual engagement, the engagement of which closes the waistband, comprising:

a first closed loop configured for engagement with a garment's waistband button; and a second closed loop configured for threading through a garment's waistband buttonhole and for mating engagement with the waistband button; and a joint connecting the first and second closed loops, at least a portion of one of the loops or of the joint including a material having elastic properties.

2. The apparatus of claim 1, wherein the dimensions of the first loop, second loop, and joint are such that when the first loop is engaged with the button and the second loop is threaded through the buttonhole and engaged with the button, the waistband is free to extend beyond its position when the buttonhole is directly engaged with the button.

3. The apparatus of claim 1, wherein the first loop comprises an elastic material.

4. The apparatus of claim 3, wherein the inner diameter of the unstretched first loop is less than the external diameter of the waistband button with which it engages.

5. The apparatus of claim 1, wherein the first loop comprises a braided elastic material.

6. The apparatus of claim 1, wherein the first loop includes an area for communication.

7. The apparatus of claim 1, wherein the second loop comprises an elastic material.

8. The apparatus of claim 7, wherein the second loop comprises a braided elastic material.

9. The apparatus of claim 1, wherein the second loop includes an area for communication.

10. The apparatus of claim 1, wherein the joint comprises a braided elastic material.

11. The apparatus of claim 1, wherein the joint includes an area for communication.

12. A waistband extender for use with a garment waistband that employs a waistband button and mating waistband buttonhole for mutual engagement, the engagement of which closes the waistband, comprising:

a first closed loop means for engaging a garment waistband button;

a second closed loop means for threading through a garment waistband buttonhole and engaging the button; and a means for joining the first loop means for engaging a garment waistband button and the second loop means for threading through a garment waistband buttonhole and engaging the button, at least a portion of one of the loop means or the joining means including a material having elastic properties.

13. The apparatus of claim 12, wherein the dimensions of the first loop means for engaging a waistband button, the second loop means for threading through a waistband buttonhole and engaging the button and the joint means for connecting the loop means for engaging a waistband button and the loop means for threading through a waistband buttonhole and engaging the button, are such that when the first loop means for engaging is engaging the button and the second loop means for threading and engaging is threaded through the buttonhole and engaged with the button, the waistband is free to extend beyond its position when the buttonhole is directly engaged with the button.

14. The apparatus of claim 12, wherein the first loop means comprises an elastic material.

15. The apparatus of claim 14, wherein the inner diameter of the unstretched first loop means for engaging is less than the external diameter of the waistband button with which it engages.

16. The apparatus of claim 12, wherein the first loop means for engaging a garment waistband button comprises a braided elastic material.

17. The apparatus of claim 12, wherein the second loop means for threading and engaging comprises an elastic material.

18. The apparatus of claim 17, wherein the second loop means for threading and engaging comprises a braided elastic material.

19. The apparatus of claim 12, wherein the means for joining comprises a braided elastic material.

20. A waistband extender for use with a garment waistband that employs a waistband button and mating waistband buttonhole for mutual engagement, the engagement of which closes the waistband, comprising:

a first closed loop configured for engagement with a garment's waistband button;

a second closed loop configured for threading through a garment's waistband buttonhole and for mating engagement with the button; and a joint connecting the first and second loops, at least a portion of one of the loops or the joint including a material having elastic properties, wherein the dimensions of the first loop, second loop, and joint are such that when the first loop is engaged with the button and the second loop is threaded through the buttonhole and engaged with the button, the waistband is free to extend beyond its position when the buttonhole is directly engaged with the button and the diameters of the first and second loops are the same.

* * * * *